US010536763B2

(12) United States Patent
Slater et al.

(10) Patent No.: US 10,536,763 B2
(45) Date of Patent: Jan. 14, 2020

(54) HEADPHONE VENTILATION

(71) Applicant: NURA HOLDINGS PTY LTD, Brunswick, Victoria (AU)

(72) Inventors: Kyle Damon Slater, Brunswick (AU); Luke John Campbell, Brunswick (AU)

(73) Assignee: NURA HOLDING PTY LTD, Brunswick (AU)

( * ) Notice: Subject to any disclaimer, the term of this patent is extended or adjusted under 35 U.S.C. 154(b) by 0 days.

(21) Appl. No.: 15/585,524

(22) Filed: May 3, 2017

(65) Prior Publication Data

US 2018/0242070 A1 Aug. 23, 2018

Related U.S. Application Data

(60) Provisional application No. 62/462,138, filed on Feb. 22, 2017.

(51) Int. Cl.
*H04R 25/00* (2006.01)
*H04R 1/10* (2006.01)

(52) U.S. Cl.
CPC ..... *H04R 1/1008* (2013.01); *H04R 1/1058* (2013.01); *H04R 2460/11* (2013.01)

(58) Field of Classification Search
CPC .. H04R 1/1008; H04R 1/1058; H04R 1/1016; H04R 1/2823; H04R 5/033; H04R 2460/11
(Continued)

(56) References Cited

U.S. PATENT DOCUMENTS 1,329,559 A * 2/1920 Tesla ..... F15C 1/00 137/842
4,138,743 A 2/1979 Elkins et al.
(Continued)

FOREIGN PATENT DOCUMENTS

CN 1311974 A 9/2001
KR 101142727 B1 5/2012
(Continued)

OTHER PUBLICATIONS

International Search Report and Written Opinion dated Jun. 9, 2017, for International Application No. PCT/IB2017/000065, 13 pages.
(Continued)

*Primary Examiner* — Phylesha Dabney
(74) *Attorney, Agent, or Firm* — Perkins Coie LLP

(57) ABSTRACT

Technology presented herein improves the comfort of over ear headphones by reducing over ear heat and therefore sweat via an active ventilation mechanism. Headphones include two or more one-way valves: one valve at the bottom of the cup allowing air to flow in, and another valve at the top of the earcup allowing air to flow out of the earcup. In the audible frequency range the valves have high acoustic impedance in both directions to prevent the sound from escaping from the earcup into the environment. In the inaudible frequency range the valves operate as an upward pump because the upward direction has low impedance and the downward direction has high impedance. The pumping action is further aided by the natural tendency of warm air to rise, and by the speaker creating positive and negative pressure within the earcup and therefore expelling or sucking in air, respectively.

23 Claims, 12 Drawing Sheets

(58) Field of Classification Search
USPC ..... 381/164, 371; 417/53
See application file for complete search history.

(56) References Cited

U.S. PATENT DOCUMENTS

| | | | | |
|---|---|---|---|---|
| 5,265,636 | A * | 11/1993 | Reed | F15C 1/146 137/14 |
| 5,876,187 | A * | 3/1999 | Forster | F04B 43/046 137/814 |
| 6,118,878 | A | 9/2000 | Jones et al. | |
| 6,227,809 | B1 * | 5/2001 | Forster | F04B 43/046 417/413.2 |
| 8,189,846 | B2 | 5/2012 | Tiscareno et al. | |
| 9,169,855 | B1 * | 10/2015 | Dyson | F15C 5/00 |
| 9,249,649 | B2 * | 2/2016 | Fripp | E21B 34/08 |
| 9,712,907 | B2 | 7/2017 | Noertker et al. | |
| 9,903,536 | B2 * | 2/2018 | Lin | F17D 1/16 |
| 9,942,647 | B2 * | 4/2018 | Di Censo | H04R 1/1091 |
| 2002/0027996 | A1 | 3/2002 | Leedom et al. | |
| 2003/0231783 | A1 | 12/2003 | Kah | |
| 2010/0166203 | A1 | 7/2010 | Peissig et al. | |
| 2010/0189277 | A1 | 7/2010 | Birgersson et al. | |
| 2010/0220885 | A1 | 9/2010 | Singh | |
| 2010/0246846 | A1 | 9/2010 | Burge et al. | |
| 2011/0268290 | A1 | 11/2011 | Lee | |
| 2012/0087519 | A1 | 4/2012 | Emilsson | |
| 2013/0202135 | A1 | 8/2013 | Hedrick et al. | |
| 2014/0079274 | A1 | 3/2014 | Monahan et al. | |
| 2014/0126736 | A1 | 5/2014 | Gauger, Jr. et al. | |
| 2015/0030173 | A1 | 1/2015 | Foudhaili et al. | |
| 2015/0193196 | A1 | 7/2015 | Lin et al. | |
| 2016/0192060 | A1 | 6/2016 | Noertker et al. | |
| 2017/0208380 | A1 | 7/2017 | Slater et al. | |
| 2017/0238096 | A1 | 8/2017 | Nakagawa et al. | |
| 2017/0325738 | A1 * | 11/2017 | Antos | A61B 5/4812 |
| 2018/0014973 | A1 * | 1/2018 | Echeverri | A61F 11/14 |

FOREIGN PATENT DOCUMENTS

| | | | |
|---|---|---|---|
| WO | 2009/041873 | A1 | 4/2009 |
| WO | 2010021414 | A1 | 2/2010 |
| WO | 2015076644 | A1 | 5/2015 |
| WO | 2016148316 | A1 | 9/2016 |

OTHER PUBLICATIONS

U.S. Appl. No. 15/398,282 of Slater, K.D. filed Jan. 4, 2017.
International Search Report and Written Opinion dated Apr. 26, 2018 of PCT/US18/17692 (9 pages).
Non-Final Office Action dated Mar. 16, 2018 of U.S. Appl. No. 15/398,282 by Slater, K. D., et al. filed Jan. 4, 2017.
U.S. Appl. No. 15/398,282 by Slater, K. D., et al. filed Jan. 4, 2017.
Tessendorfm B., et al., "Improving Game Accessibility with Vibrotactile-Enhanced Hearing Instruments," ICCHP 2012, Part I, LNCS 7382, pp. 463-470 (2012).

* cited by examiner

HEADPHONE VENTILATION

CROSS-REFERENCE TO RELATED APPLICATIONS

This application claims priority to the U.S. provisional patent application Ser. No. 62/462,138 filed on Feb. 22, 2017 which is incorporated herein by reference in its entirety.

TECHNICAL FIELD

The present application is related to a ventilation system, and more specifically to methods and systems that ventilate headphones.

BACKGROUND

To provide a good acoustic seal when a listener is listening to music played by over ear headphones, the earcups placed around the listener's ears create a seal to prevent sound escaping from the earcups into the environment, or the sound from the environment entering the earcups. Consequently, heat emitted from the listener's skin gets trapped within the earcups, and can cause the listener to sweat, thus creating discomfort to the listener's ears.

SUMMARY

Technology presented herein improves the comfort of over ear headphones by reducing over ear heat and therefore sweat via an active ventilation mechanism. Heat transferred via the skin to the air volume enclosed within the is ventilated into the outside environment. In one embodiment, headphones include two or more one-way valves (i.e., anisotropic valves)—one valve positioned at the bottom of the cup allowing air to flow in and another valve positioned at the top of the earcup allowing air to flow out of the earcup. The one-way valves can either be geometrically fixed or dynamic. In the audible frequency range the valves have high acoustic impedance in both directions to prevent the sound from escaping from the earcup into the environment. In a portion of the inaudible frequency range the valves operate as an upward pump because the upward direction has low impedance and the downward direction has high impedance. The pumping action is further aided by the natural tendency of warm air to rise within the earcup. Effectively, in the inaudible frequency range the bottom valve sucks the cool air from the outside, and the top valve pushes the rising warm air from the earcup into the environment. In addition, the speaker can aid the pumping action. For example, as the speaker creates transient negative and positive pressure within the earcup, air is pulled in from the base valve (negative pressure) and expelled out from the top valve (positive pressure). Further, the technology presented here can be used in other situations where ventilation is needed.

BRIEF DESCRIPTION OF THE DRAWINGS

These and other objects, features and characteristics of the present embodiments will become more apparent to those skilled in the art from a study of the following detailed description in conjunction with the appended claims and drawings, all of which form a part of this specification. While the accompanying drawings include illustrations of various embodiments, the drawings are not intended to limit the claimed subject matter.

DETAILED DESCRIPTION

Terminology

Figure 1:
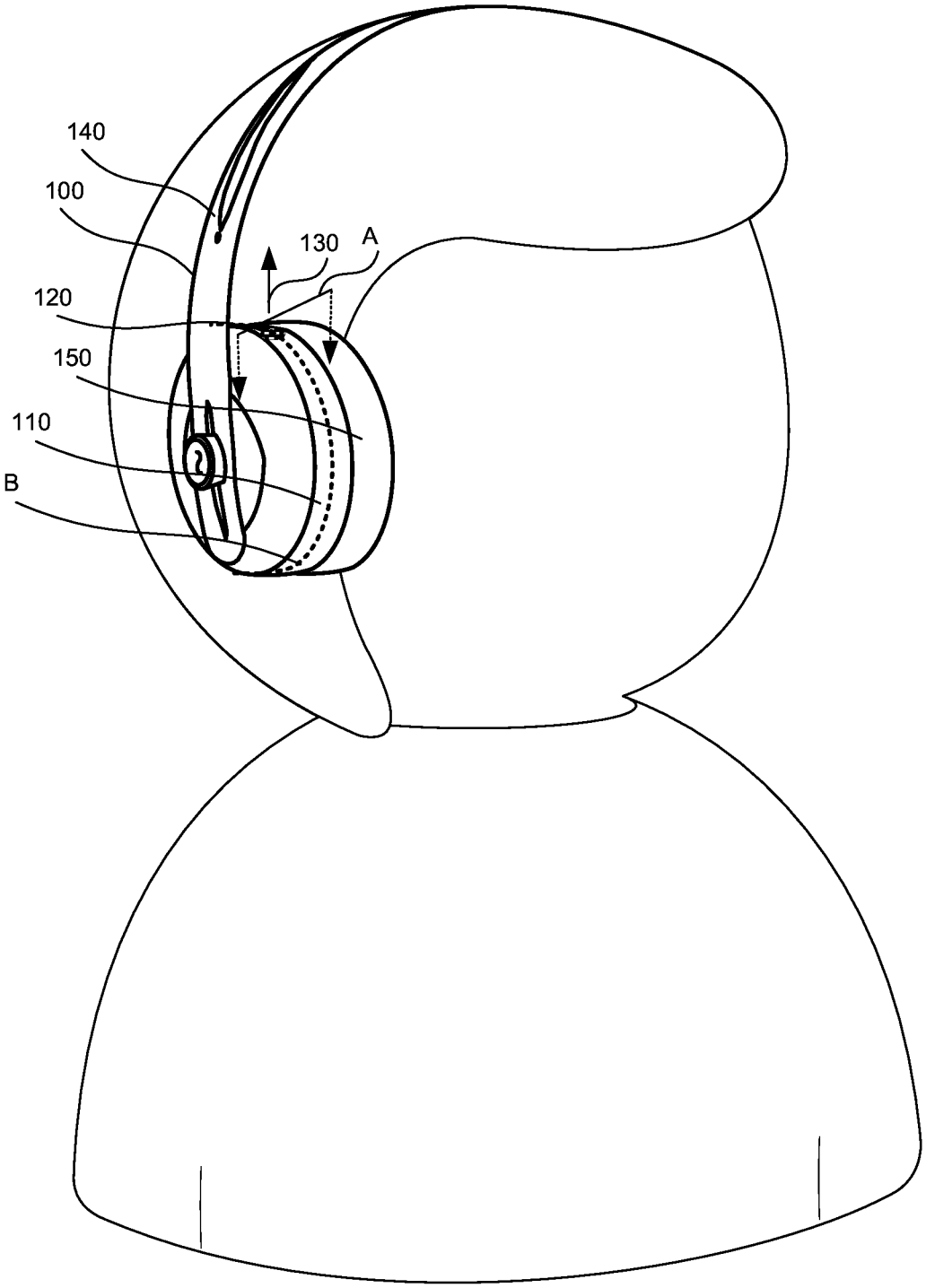
FIG. 1 shows headphones placed proximate to a listener's head, according to one embodiment.

Brief definitions of terms, abbreviations, and phrases used throughout this application are given below.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not others.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements. The coupling or connection between the elements can be physical, logical, or a combination thereof. For example, two devices may be coupled directly, or via one or more intermediary channels or devices. As another example, devices may be coupled in such a way that information can be passed there between, while not sharing any physical connection with one another. Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list.

If the specification states a component or feature "may," "can," "could," or "might" be included or have a characteristic, that particular component or feature is not required to be included or have the characteristic.

The term "module" refers broadly to software, hardware, or firmware components (or any combination thereof). Modules are typically functional components that can generate useful data or another output using specified input(s). A module may or may not be self-contained. An application program (also called an "application") may include one or more modules, or a module may include one or more application programs.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same, in the same context, whether or not it is highlighted. It will be appreciated that the same element can be described in more than one way.

Consequently, alternative language and synonyms may be used for any one or more of the terms discussed herein, but special significance is not to be placed upon whether or not a term is elaborated or discussed herein. A recital of one or more synonyms does not exclude the use of other synonyms. The use of examples anywhere in this specification, including examples of any terms discussed herein, is illustrative only and is not intended to further limit the scope and meaning of the disclosure or of any exemplified term. Likewise, the disclosure is not limited to various embodiments given in this specification.

Ventilation System

FIG. 1 shows headphones placed proximate to a listener's head, according to one embodiment. Headphones 100 include an earcup 110 placed over a listener's ear, an ear pad 150 resting against the listener's head, a headband 140, and one or more valves 120. The one or more valves 120 can be referred to as a first valve and a second valve. The earcup 110 encloses the listener's ear to isolate the listener from outside noises, and to prevent sounds within the earcup 110 from leaking into the outside environment. As a result of the enclosure, the earcup 110 can retain heat inside the earcup 110, such as body heat emanating from the listener and/or heat produced by the electronic components contained within the earcup 110. The valve 120 can be an anisotropic valve meaning that the valve 120 provides different impedance, i.e., resistance, depending on the direction in which a fluid flows through the valve 120. Fluid can be a gas, such as air, or a liquid. For example, the anisotropic valve 120 can provide small impedance, or no impedance to the heated air inside the earcup 110 moving in the direction 130, while providing high impedance or completely blocking the air outside the earcup 110 from entering the earcup 110.

The one or more valves 120 can be used in conjunction with an earbud as described in the application Ser. No. 15/398,282, filed on Jan. 4, 2017, and incorporated herein by this reference, in its entirety. Any unwanted sound produced by the one or more valves 120 is attenuated by the ear-bud inserted into the listener's ear.

Figure 2:
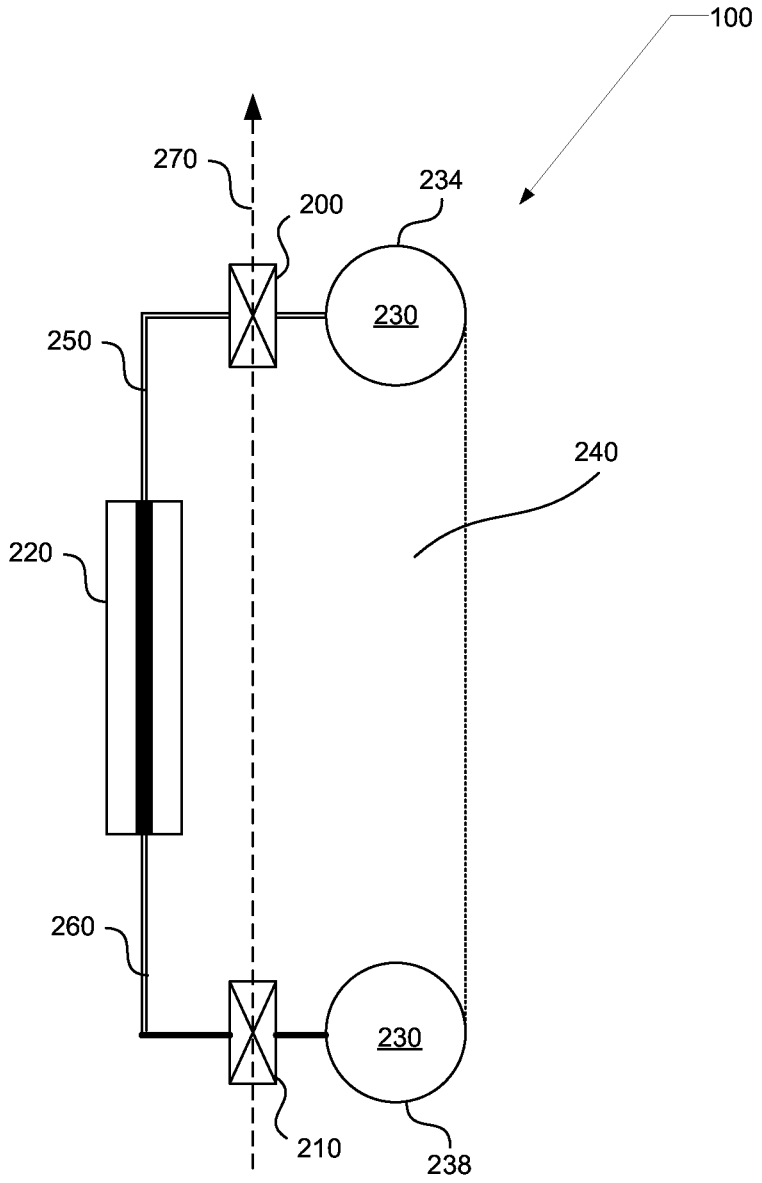
FIG. 2 is a cross-section of an earcup along line A in FIG. 1.

FIG. 2 is a cross-section of an earcup along line A in FIG. 1. The earcup 100 includes two or more anisotropic valves 200, 210 (i.e., a first valve and a second valve), a speaker 220, and a cavity 240. An ear pad 230 rests against the listener's head. The earcup 100 is a heat retaining member because the earcup 100 retains heat emanating from a listener within the cavity 240 defined by the earcup 100. The anisotropic valves 200, 210, and/or the speaker 220 act as a ventilation system to circulate cooler air from the outside environment into the earcup 100.

The earcup 100 includes a top surface 250, and a bottom surface 260, where the top surface 250 and the bottom surface 260 are substantially the same in area. The top surface 250 extends between the speaker 220 and the top part 234 of the ear pad 230, while the bottom surface 260 extends between the speaker 220 and the bottom part 238 of the ear pad 230.

The anisotropic valve 200 is positioned at the top surface 250 of the earcup 100 providing low impedance, first impedance, to the warm air inside the cavity 240 flowing out of the cavity 240, and providing high impedance, second impedance, to cooler air from outside attempting to enter the cavity 240. The anisotropic valve 210 is positioned at the bottom surface 260 of the earcup 100 providing low impedance, third impedance, to cool air from outside flowing into the cavity 240, and providing high impedance, fourth impedance, to warm air from inside the cavity 240 attempting to flow out. First impedance can be substantially the same as the third impedance, while second impedance can be substantially the same as the fourth impedance.

The air flow 270 between the valves 200, 210 is also aided by the natural tendency of warm air to rise upward. The warm air inside the cavity 240 rises towards the anisotropic valve 200, thus creating a suction at the anisotropic valve 210, which in turn takes in the cool air from the outside. The anisotropic valves 200, 210, combined with the natural tendency of warm air to rise upwards create a pump, i.e., a pumping member, of the earcup 100, which ventilate the earcup 100. In addition to the natural tendency of warm air to rise upward, the flow of air towards the anisotropic valve 200 is aided by the speaker 220 creating transient negative and positive pressure within the cavity 240. The speaker 220 can be a driving member of the pump.

The anisotropic valves 200, 210 can either be geometrically static or geometrically dynamic. A geometrically static valve does not change geometry during operation, while a geometrically dynamic valve change geometry during operation. An example of a geometrically static valve is a Tesla valve. An example of a geometrically dynamic valve is: a ball check valve, a diaphragm check valve, swing check valve, a stopped check valve, a list check valve, in-line check valve, a duckbill valve, a pneumatic non-return valve, a micro electromechanical system (MEMS) valve etc.

Figure 3A:
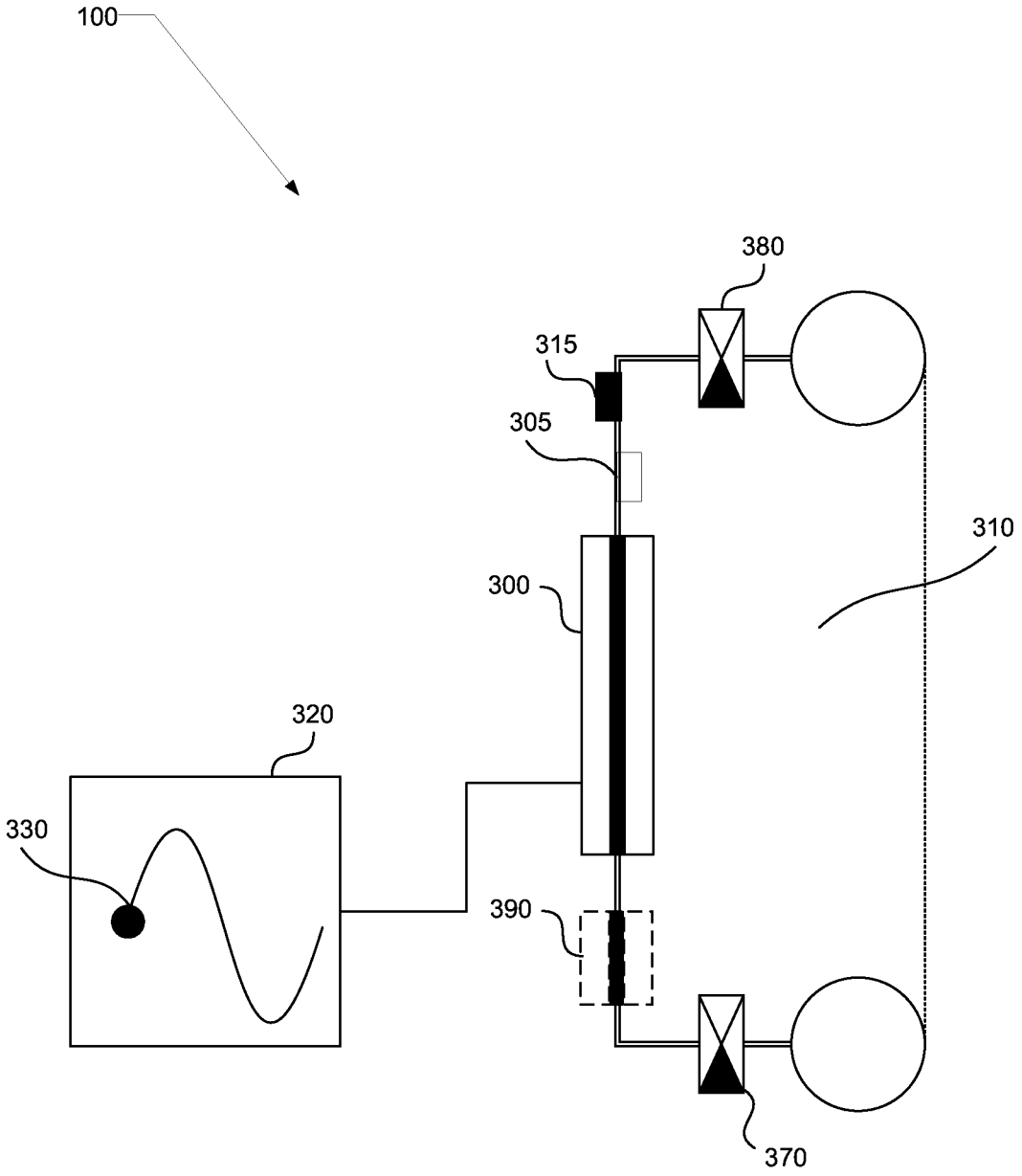
FIGS. 3A-3C show three stages of air flow within an earcup cavity caused by a speaker.
Figure 3B:
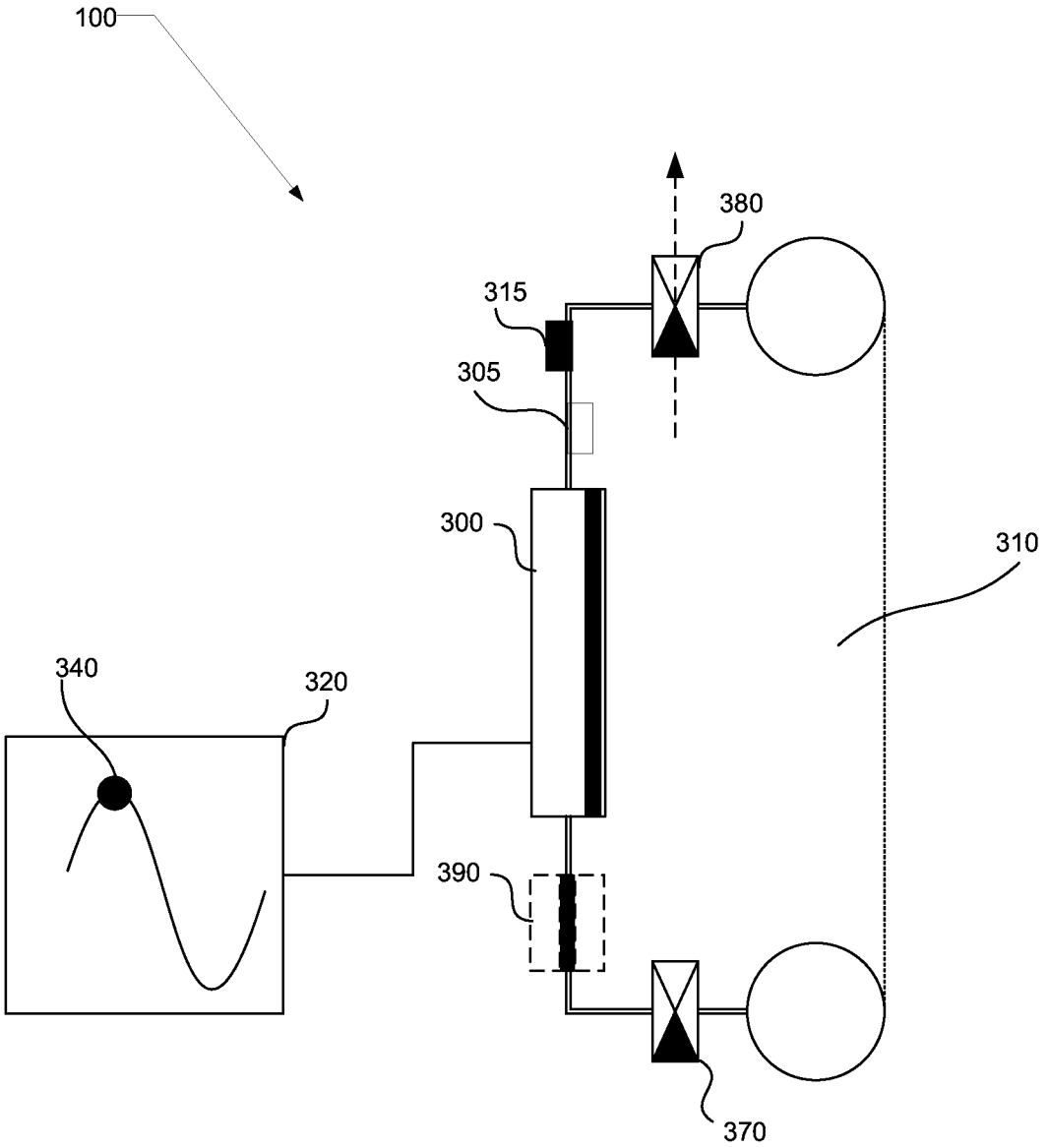
Figure 3C:
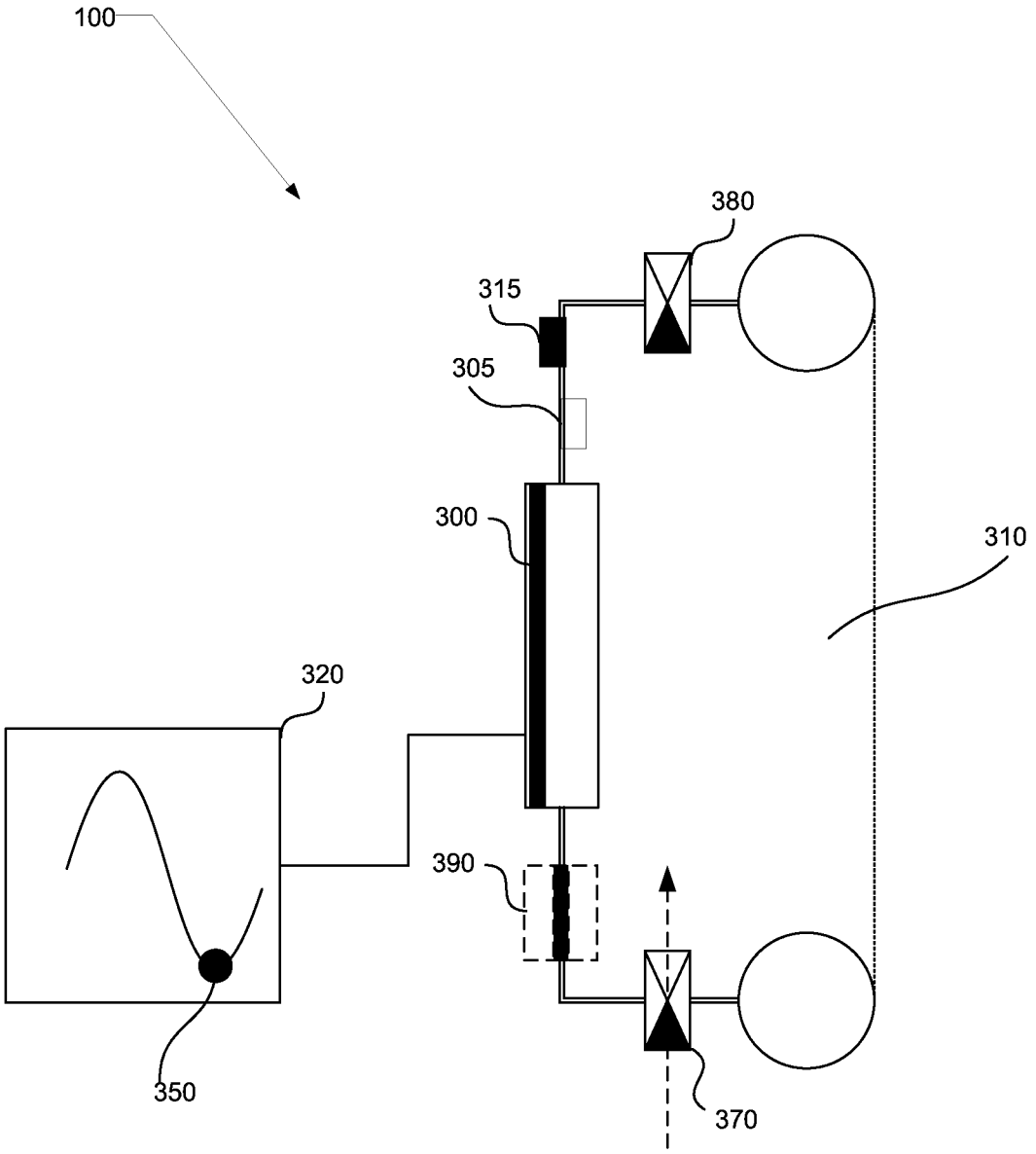

FIGS. 3A-3C show three stages of air flow within an earcup cavity caused by a speaker. The three stages of airflow are equilibrium, exhaust, and intake. The speaker 300 associated, which can be a pumping member, with the earcup 100 creates transient negative and positive pressure within the cavity 310, with varying amplitude of sound 320 played through the speaker 300. FIG. 3A shows the equilibrium stage, when either the speaker 300 does not play a sound, or the amplitude 330 of the sound is close to 0. FIG. 3B shows the exhaust stage, when the speaker 300 creates positive pressure by playing the sound 340, and as a result expelling air through the top anisotropic valve 380 (can be a first valve or a second valve). FIG. 3C shows the intake stage, when the speaker 300 creates negative pressure by playing the sound 350, and as a result pulling air in through the bottom anisotropic valve 370 (can be a first valve or a second valve).

In addition to the speaker 300 causing ventilation inside the cavity 310 by playing audible sound, the speaker 300 can play inaudible sound to further cause ventilation, that is, flow of air, inside the cavity 310. The inaudible sound includes frequencies below 20 Hz. For example, in addition to admitting audible frequencies, the speaker 300 can emit inaudible frequencies in 5 to 10 Hz range. In one embodiment, instead of a single speaker 300 emitting both audible and inaudible frequencies, a separate speaker 390 can be added to the headphones to admit frequencies in the inaudible range.

Pumping members 300, 390 can play the inaudible frequencies continuously, or can play the inaudible frequencies when activated by an optional temperature sensor 305, or by the listener. The temperature sensor 305 can measure the temperature inside the cavity 310, in when the measured temperature exceeds a predefined threshold, the temperature sensor 305 can activate the speakers 300, 390 to emit inaudible sound, and thus further induce the ventilation of the cavity 310. The predefined threshold can be 37° C.

Alternatively, or in addition to the temperature sensor 305 the listener can manually activate the pumping members 300, 390 by, for example, pressing a button 315 located on the external surface of the earcup 100. The button 315 can be located on the headband of the headphones, or on a cable associated with the headphones, such that pressing the button ventilates both earcups simultaneously.

Figure 4:
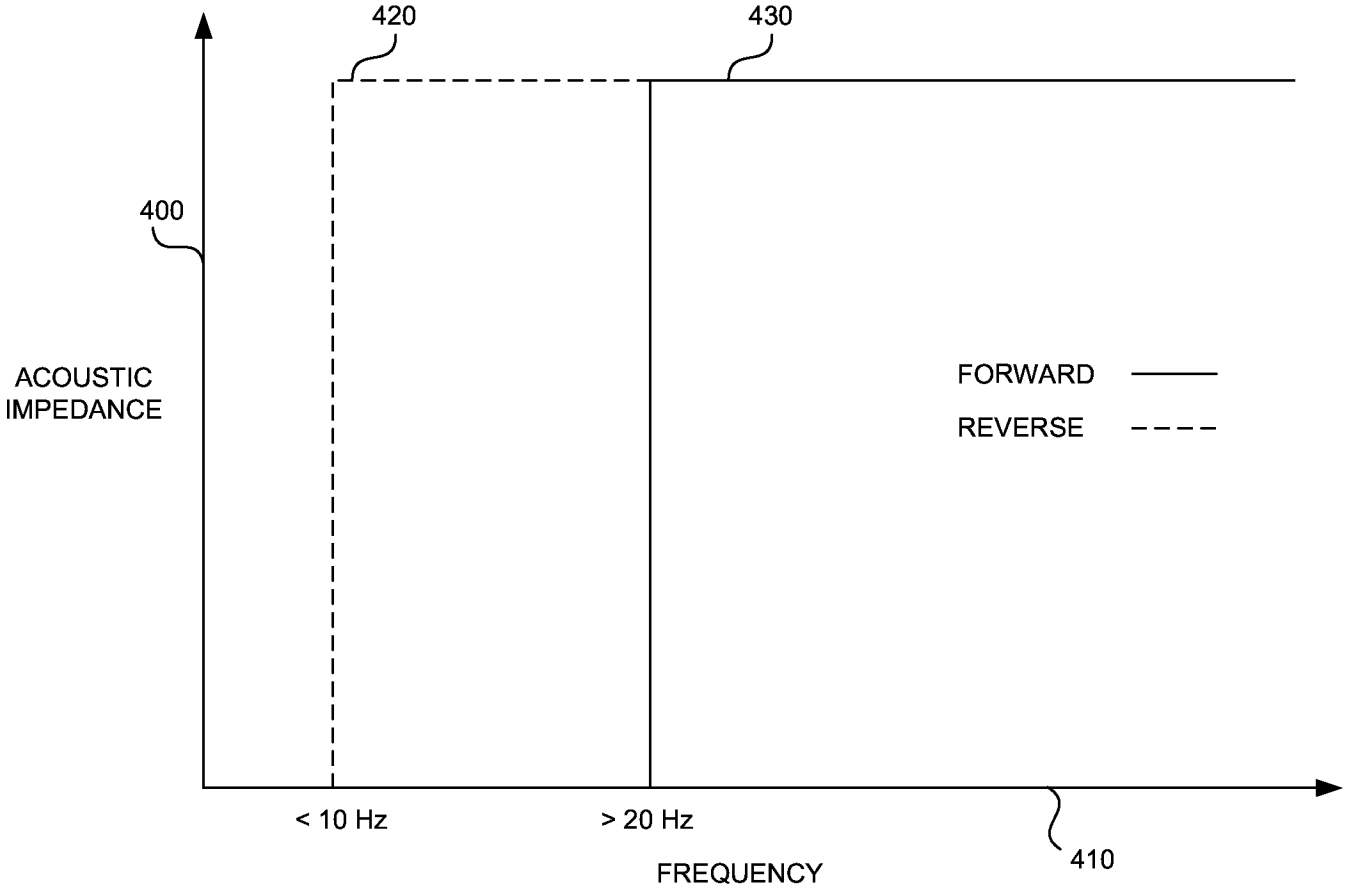
FIG. 4 shows how impedance of an anisotropic valve varies with sound frequencies.

FIG. 4 shows how impedance of an anisotropic valve varies with sound frequencies. The Y axis 400 represents acoustic impedance of the anisotropic valve 200, 210 in FIG. 2, 370, 380 in FIGS. 3A-3C. The X axis 410 represents frequency of a sound. The dotted line 420 represents impedance of the anisotropic valve in the high impedance direction, while the solid line 430 represents impedance of the anisotropic valve in the low impedance direction. Below 10 Hz the anisotropic valve 200, 210 in FIG. 2, 370, 380 in FIGS. 3A-3C is basically bidirectional, allowing air to flow unimpeded through the valve in both the high impedance in the low impedance directions. Between 10 Hz and 20 Hz a pair of the anisotropic valves 200, 210 in FIG. 2, 370, 380 in FIGS. 3A-3C act as a pump since forward direction provides low impedance and is open and reverse direction provides high impedance and is closed. Above 20 Hz the anisotropic valve 200, 210 in FIG. 2, 370, 380 in FIGS. 3A-3C blocks any audible sound from the earcup 100 in FIG. 1 escaping into the outside environment, and the audible sound from the outside environment entering into the earcup 100 and FIG. 1.

Figure 5A:
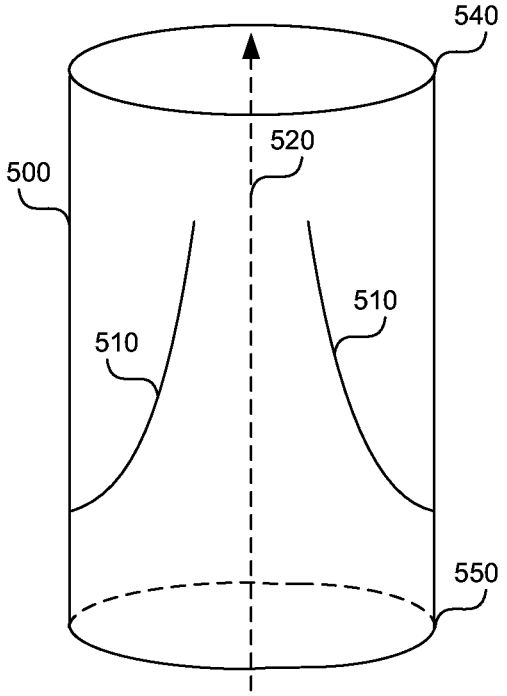
FIGS. 5A-5B show a geometrically dynamic anisotropic valve, according to one embodiment.
Figure 5B:
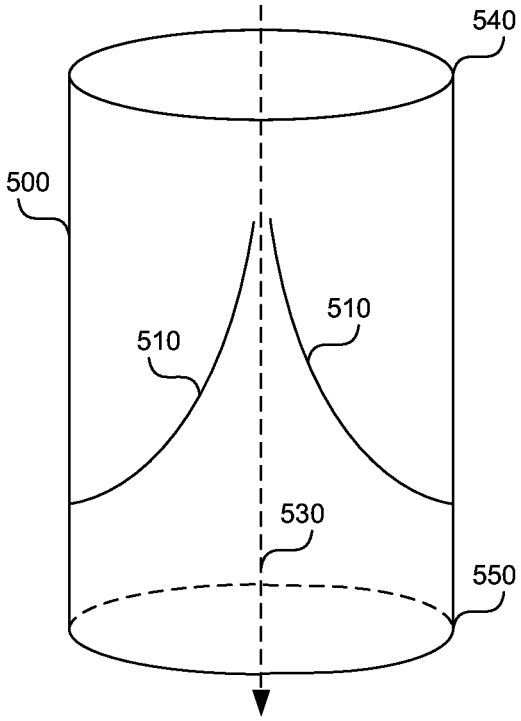

FIGS. 5A-5B show a geometrically dynamic anisotropic valve, according to one embodiment. The geometrically dynamic anisotropic valve 500 (can be a first valve and/or a second valve) contains one or more resistive members 510, a first aperture 540, and a second aperture 550. Fluid flows, i.e., enters and exits the valve 500, between the first aperture 540 and the second aperture 550. The resistive member 510 moves when the fluid exerts pressure on the resistive member 510.

FIG. 5A shows fluid moving in the direction of low impedance 520 of the valve 500. When the fluid moves in the direction of low impedance 520 of the valve 500, the resistive member 510 moves towards the inner surface of the valve 500, opening up the substantially the full width of the valve 500 to allow the fluid to flow through the valve 500.

FIG. 5B shows fluid moving in the direction of a high impedance 530 of the valve 500. When the fluid moves in the direction of high impedance 530 of the valve 500, the resistive member 510 moves towards the center of the valve, thus narrowing or completely closing the opening within the valve 500 through which the fluid can flow.

Figure 6A:
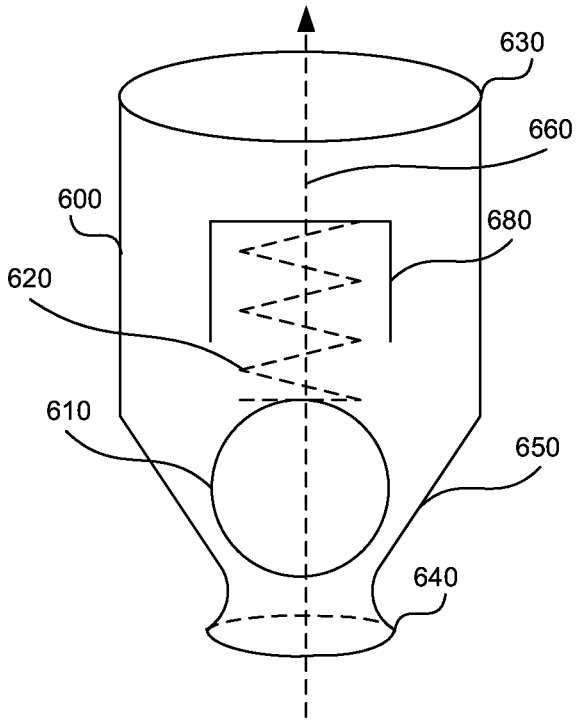
FIGS. 6A-6B show a geometrically dynamic valve, according to another embodiment.
Figure 6B:
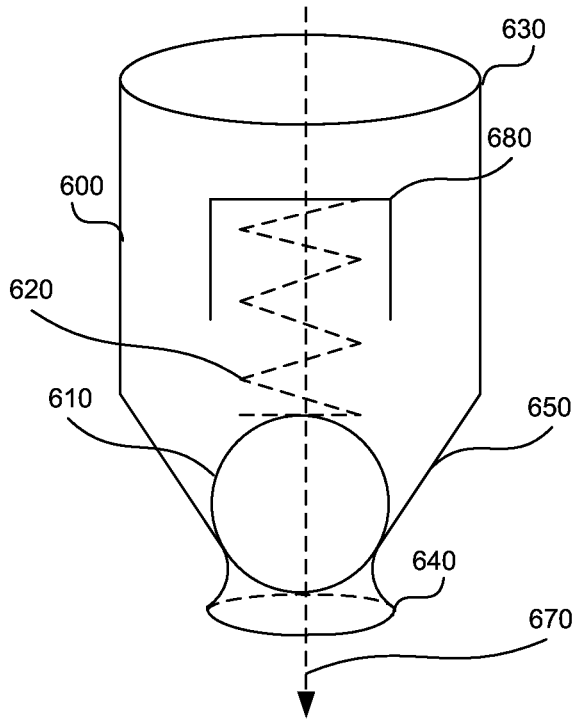

FIGS. 6A-6B show a geometrically dynamic valve, according to another embodiment. The geometrically dynamic valve 600 (can be a first valve or a second valve) contains a resistive member 610, an optional spring 620, a first aperture 630, a second aperture 640, and a stopping member 680. The geometrically dynamic valve 600 can be a ball check valve in which the resistive member 610, blocking the flow of fluid, is a spherical ball. The resistive member 610 can take various shapes such as an ellipsoid. Although the ball 610 is most often made of metal, the ball 610 can be made of other materials, or in some specialized cases out of artificial ruby. In some ball check valves 600, the ball 610 can be spring-loaded with the spring 620 to help keep the valve 600 shut. For those designs without a spring, reverse flow is required to move the ball toward the second aperture 640 and create a seal. The interior surface 650 of the valve 600 leading to the second aperture 640 is substantially conically-tapered to guide the resistive member 610 into the second aperture 640 and form a positive seal when stopping reverse flow.

FIG. 6A shows fluid moving in the direction 660 of low impedance of the valve 600. When the fluid moves in the direction 660 of low impedance of the valve 600, the resistive member 610 moves towards the aperture 630, thus opening up the aperture 640 to allow the fluid to flow through the valve 600. Stopping member 680 is positioned inside the valve 600, and prevents the resistive member 610 from being carried out of the valve through the aperture 630, when the fluid moves in the direction 660 of low impedance.

FIG. 6B shows fluid moving in the direction 670 of a high impedance of the valve 600. When the fluid moves in the direction 670 of high impedance of the valve 600, the resistive member 610 moves towards the second aperture 640, thus completely closing the aperture 640 within the valve 600 through which the fluid can flow.

Figure 7:
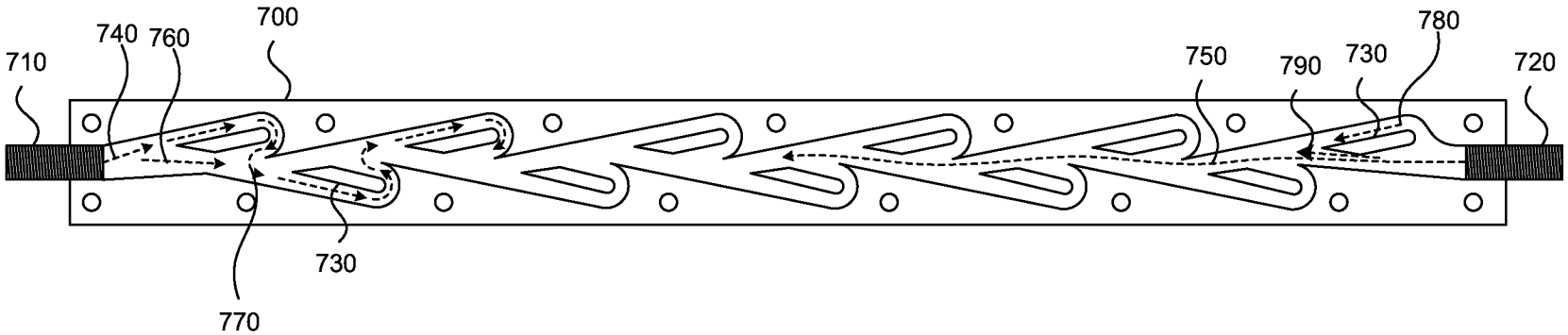
FIG. 7 shows a geometrically static valve.

FIG. 7 shows a geometrically static valve. The geometrically static valve 700 (can be a first valve and/or a second valve) can be a Tesla valve. The geometrically static valve 700 contains a first aperture 710, a second aperture 720, and one or more resistive members 730. The cross-section of the geometrically static valve 700 can be a square, circle, a rectangle, can be a shape with rounded corners, etc. The resistive member 730 provides high impedance to a fluid flowing through the valve in direction 740, while providing low impedance to the fluid flowing through the valve in direction 750. The resistive member 730 creates turbulent flow by causing collision of fluid flowing in directions 760, 770, thus creating high impedance in direction 740. The resistive member 730 creates smooth flow of fluid flowing in direction 780, 790, thus creating low impedance in direction 750.

Various parameters of the geometrically static valve 700 can be varied while still preserving the anisotropic characteristic of the geometrically static valve 700. The parameters that can be varied are, the width of the valve 700, the width to depth ratio of the valve 700, the size of the one or more resistive member 730, the shape of the resistive member 730, the relative position between 2 resistive member 730, and the number of the resistive member 730. When varying the shape of the resistive member 730, the length, and the angles of the resistive member 730 can be varied.

Figure 8:
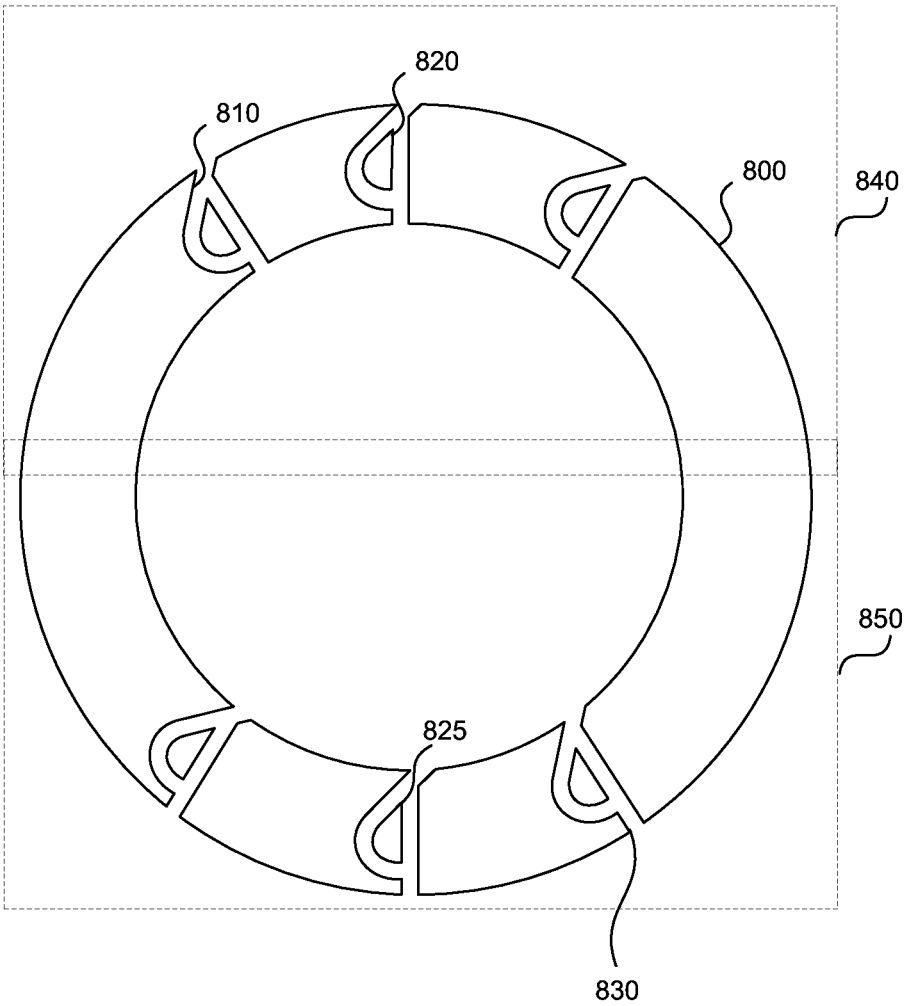
FIG. 8 shows a cross-section of an earcup along line B in FIG. 1.

FIG. 8 shows a cross-section of an earcup along line B in FIG. 1. Two or more geometrically static valves 810, 830 (only two labeled for brevity) can be integrated into the earcup 800. The geometrically static valve 810, 830 (can be a first valve and/or a second valve) can have one or more resistive members 820, 825 (only two labeled for brevity). The pictured geometrically static valves 810, 830 have one resistive member. The geometrically static valve 810, 830 can be a Tesla valve. The geometrically static valve 810, 830 can be manufactured as a pattern sandwiched between two elements in the headphones, for example between the earcup 100 in FIG. 1 and the ear pad 150 in FIG. 1. Alternatively, or in addition, the valves 810 can be formed within the earcup 100 in FIG. 1. Multiple valves 810 can be formed along the circumference of the earcup, with half pointing inward and half outwards.

In one embodiment, each valve 810 placed on a top surface 840 of the earcup 800 can have a corresponding valve 830 placed on the bottom surface 850 of the earcup 800. The top valve 810 and the bottom valve 830 can be oriented in substantially the same direction, or within 30° of each other.

Figure 9:
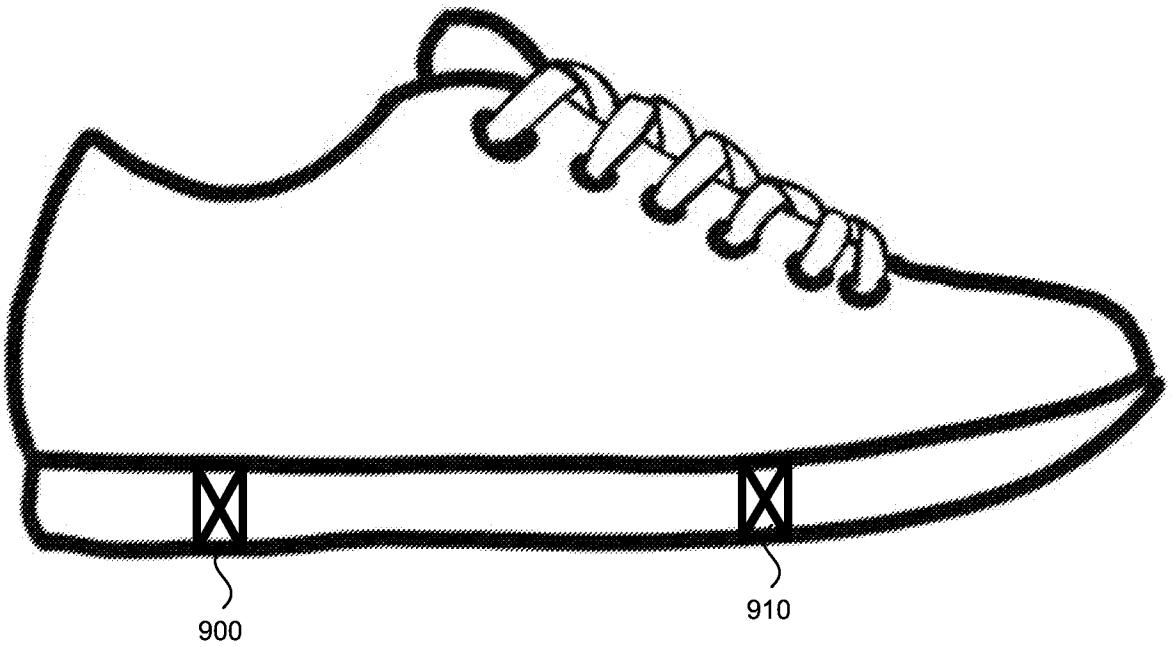
FIG. 9 shows a shoe with a pumping member formed inside the shoe sole.

FIG. 9 shows a shoe with a pumping member formed inside the shoe sole. The ventilation system disclosed in this application can be applied to various heat retaining members, such as a shoes, athletic wear, mobile devices, computers, etc. The pumping member contains two or more anisotropic valves 900, 910 (i.e., a first valve and a second valve) as described in this application. One valve allows the air to leave the shoe with low impedance, while the other valve allows the air to enter the shoe with low impedance. The valves 900, 910 can be integrated into the shoe sole, top of the shoe, side of the shoe, inside the lace holes, etc. The action of a wearer of the shoe stepping up and down creates a large pressure change which can be used to drive airflow through the shoe.

Figure 10:
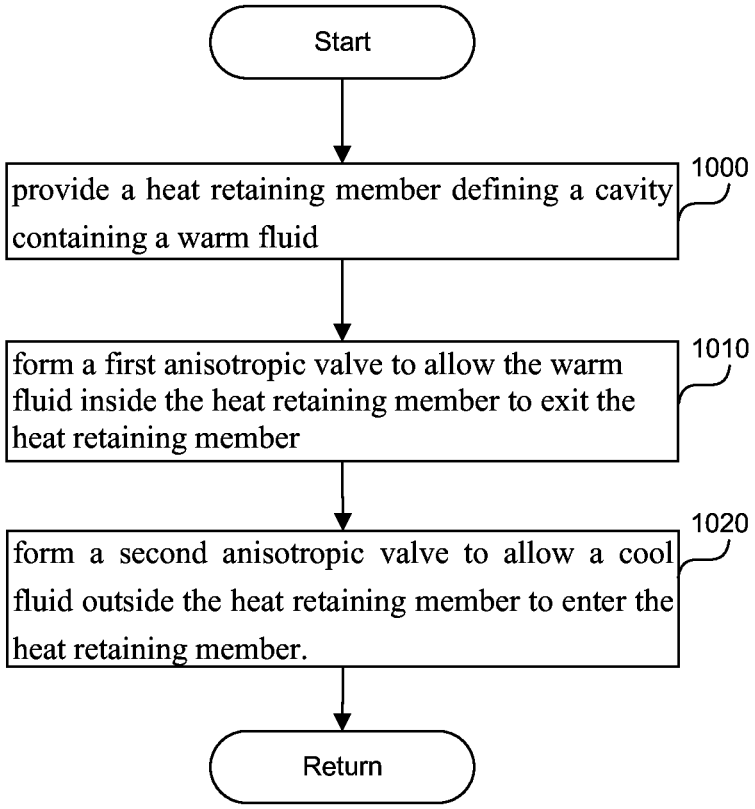
FIG. 10 is a flowchart of a method to manufacture a ventilation system as described in this application.

FIG. 10 is a flowchart of a method to manufacture a ventilation system as described in this application. In step 1000, a heat retaining member is provided defining a cavity containing a fluid.

In step 1010, a first anisotropic valve is formed and placed within a surface of the heat retaining member and allows the warm fluid inside the heat retaining member to exit the heat retaining member. The first anisotropic valve has a first impedance in the first direction and a second impedance in a direction substantially opposite the first direction. The first impedance is less than the second impedance.

In step 1020, a second anisotropic valve is formed and placed within the surface of the heat retaining member and allows a cool fluid outside the heat retaining member to enter the heat retaining member. The second valve is substantially oriented in a second direction of a flow of the fluid away from the surface of the heat retaining member. The second anisotropic valve has a third impedance in the second direction and a fourth impedance in a direction substantially opposite the second direction. The third impedance is less than the fourth impedance. The first impedance can be substantially the same as the third impedance, and the second impedance can be substantially the same as the fourth impedance. The first and second direction can be substantially the same, such as they can be the same, or within a 30° angle of each other.

The method can include providing the first anisotropic valve comprising a first aperture, a second aperture, and a resistive member to create a varying impedance in the substantially upward direction and a substantially downward direction. The anisotropic valve can be a geometrically dynamic valve, or a geometrically static valve.

The method can include providing a driving member to cause the fluid to flow in the substantially upward direction. The pumping member can include a speaker configured to emit frequencies below 20 Hz.

The method can include providing a temperature sensor to measure a temperature of the fluid and to activate the pumping member when the temperature is above a predetermined threshold, such as 37° C.

The method can include providing a mechanism enabling the user to activate the pumping member, such as a button placed on the outside of the earcup, on the headphone headband, on the cable attached to the headphone, etc.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

While embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. A system comprising:

a heat retaining member to enclose internal fluid, the heat retaining member comprising a top surface and a bottom surface;

a pumping member disposed within the heat retaining member, the pumping member comprising a speaker to cause internal fluid to flow in a substantially upward direction and comprising:

a first anisotropic valve comprising a Tesla valve to allow internal fluid inside the heat retaining member to exit the heat retaining member, the first anisotropic valve disposed on the top surface of the heat retaining member and oriented in a first substantially up-down direction and comprising a first impedance in a first substantially upward direction and a second impedance in a first substantially downward direction, wherein the first impedance is less than the second impedance; and a second anisotropic valve to allow external fluid outside the heat retaining member to enter the heat retaining member, the second anisotropic valve disposed on the bottom surface of the heat retaining member and oriented in a second substantially up-down direction and comprising a third impedance in a second substantially upward direction and a fourth impedance in a second substantially downward direction, wherein the third impedance is less than the fourth impedance.

2. The system of claim 1, wherein the first impedance is substantially the same as the third impedance, and the second impedance is substantially the same as the fourth impedance.

3. The system of claim 1, the first anisotropic valve comprising a first aperture, a second aperture, and a resistive member to create a varying impedance in the first substantially upward direction and the first substantially downward direction.

4. The system of claim 1, the speaker configured to emit frequencies below 20 Hz.

5. The system of claim 1, comprising a temperature sensor to measure a temperature of internal fluid and to activate the pumping member when the temperature is above a predefined threshold.

6. The system of claim 1, comprising a mechanism enabling a user to activate the pumping member.

7. The system of claim 1, the first anisotropic valve comprising at least one of a geometrically dynamic valve, or a geometrically static valve.

8. A system comprising:

a heat retaining member defining a cavity containing internal fluid;

a pumping member to allow internal fluid to flow outside the heat retaining member, the pumping member comprising a speaker to cause internal fluid to flow in a first direction, the pumping member disposed within the heat retaining member and comprising:

a first valve to allow internal fluid inside the heat retaining member to exit the heat retaining member, the first valve disposed within a surface of the heat retaining member and comprising a first impedance in the first direction and a second impedance in a direction substantially opposite the first direction, wherein the first impedance is less than the second impedance; and a second valve to allow external fluid outside the heat retaining member to enter the heat retaining member, the second valve disposed within the surface of the heat retaining member and comprising a third impedance in a second direction and a fourth impedance in a direction substantially opposite the second direction, wherein the third impedance is less than the fourth impedance.

9. The system of claim 8, wherein the first impedance is substantially the same as the third impedance, and the second impedance is substantially the same as the fourth impedance.

10. The system of claim 8, the first valve comprising a first aperture, a second aperture, and a resistive member to create a varying impedance in the first direction and the direction substantially opposite the first direction.

11. The system of claim 8, the speaker configured to emit frequencies below 20 Hz.

12. The system of claim 8, comprising a temperature sensor to measure a temperature of internal fluid and to activate the pumping member when the temperature is above a predetermined threshold.

13. The system of claim 8, comprising a mechanism enabling a user to activate the pumping member.

14. The system of claim 8, the first valve comprising at least one of a geometrically dynamic valve, or a geometrically static valve.

15. The system of claim 8, comprising an earbud to prevent a sound generated by the first valve and the second valve from entering a listener's ear.

16. The system of claim 8, the first valve comprising a Tesla valve.

17. A method comprising:

providing a heat retaining member to enclose internal fluid, the heat retaining member comprising a top surface and a bottom surface;

providing a pumping member disposed within the heat retaining member, the pumping member comprising a speaker to cause internal fluid to flow in a substantially upward direction and comprising:

a first anisotropic valve comprising a Tesla valve to allow internal fluid inside the heat retaining member to exit the heat retaining member, the first anisotropic valve disposed on the top surface of the heat retaining member and oriented in a first substantially up-down direction and comprising a first impedance in a first substantially upward direction and a second impedance in a first substantially downward direction, wherein the first impedance is less than the second impedance; and a second anisotropic valve to allow external fluid outside the heat retaining member to enter the heat retaining member, the second anisotropic valve disposed on the bottom surface of the heat retaining member and oriented in a second substantially up-down direction and comprising a third impedance in a second substantially upward direction and a fourth impedance in a second substantially downward direction, wherein the third impedance is less than the fourth impedance.

18. The method of claim 17, wherein the first impedance is substantially the same as the third impedance, and the second impedance is substantially the same as the fourth impedance.

19. The method of claim 17, the first anisotropic valve comprising a first aperture, a second aperture, and a resistive member to create a varying impedance in the first substantially upward direction and the first substantially downward direction.

20. The method of claim 17, the speaker configured to emit frequencies below 20 Hz.

21. The method of claim 17, comprising providing a temperature sensor to measure a temperature of internal fluid and to activate the pumping member when the temperature is above a predefined threshold.

22. The method of claim 17, comprising providing a mechanism enabling a user to activate the pumping member.

23. The method of claim 17, the first anisotropic valve comprising at least one of a geometrically dynamic valve, or a geometrically static valve.

* * * * *